US007001265B1

(12) United States Patent
Beaty

(10) Patent No.: US 7,001,265 B1
(45) Date of Patent: Feb. 21, 2006

(54) AIR EXHAUST SYSTEM

(76) Inventor: Terry L. Beaty, P.O. Box 264, Bowie, TX (US) 76230-0264

( * ) Notice: Subject to any disclaimer, the term of this patent is extended or adjusted under 35 U.S.C. 154(b) by 139 days.

(21) Appl. No.: 10/368,298

(22) Filed: Feb. 18, 2003

Related U.S. Application Data

(63) Continuation-in-part of application No. 09/965,980, filed on Sep. 28, 2001, now abandoned.

(51) Int. Cl.
*F24F 7/007* (2006.01)

(52) U.S. Cl. ..... 454/345; 454/347

(58) Field of Classification Search ..... 454/18, 454/17, 366, 345, 19, 347; 236/49; 126/299 D
See application file for complete search history.

(56) References Cited

U.S. PATENT DOCUMENTS 490,027 A * 1/1893 Lochman ..... 454/19
4,759,272 A * 7/1988 Zaniewski ..... 454/344
4,779,671 A * 10/1988 Dolison ..... 165/248
6,328,776 B1 * 12/2001 Shanks et al. ..... 55/385.2

* cited by examiner

*Primary Examiner*—Derek S. Boles
(74) *Attorney, Agent, or Firm*—Edward P. Dutkiewicz

(57) ABSTRACT

An air exhaust system comprises a chamber. The chamber has side walls, a ceiling, an attic and a roof. The ceiling and roof have air flow apertures. Provided next is a duct with upper and lower ends. A turbine fan is provided. The fan is operatively coupled to the upper end of the duct and rotatable about a vertical axis. The fan is further adapted to be self rotated as the air moves from a location in the chamber to a cooler location above the fan. Last provided is a damper. The damper is located above the lower end of the duct. The damper is moveable between closed and open orientations. The closed orientation precludes the flow of air through the duct. The open orientation allows for the flow of air through the duct.

2 Claims, 2 Drawing Sheets

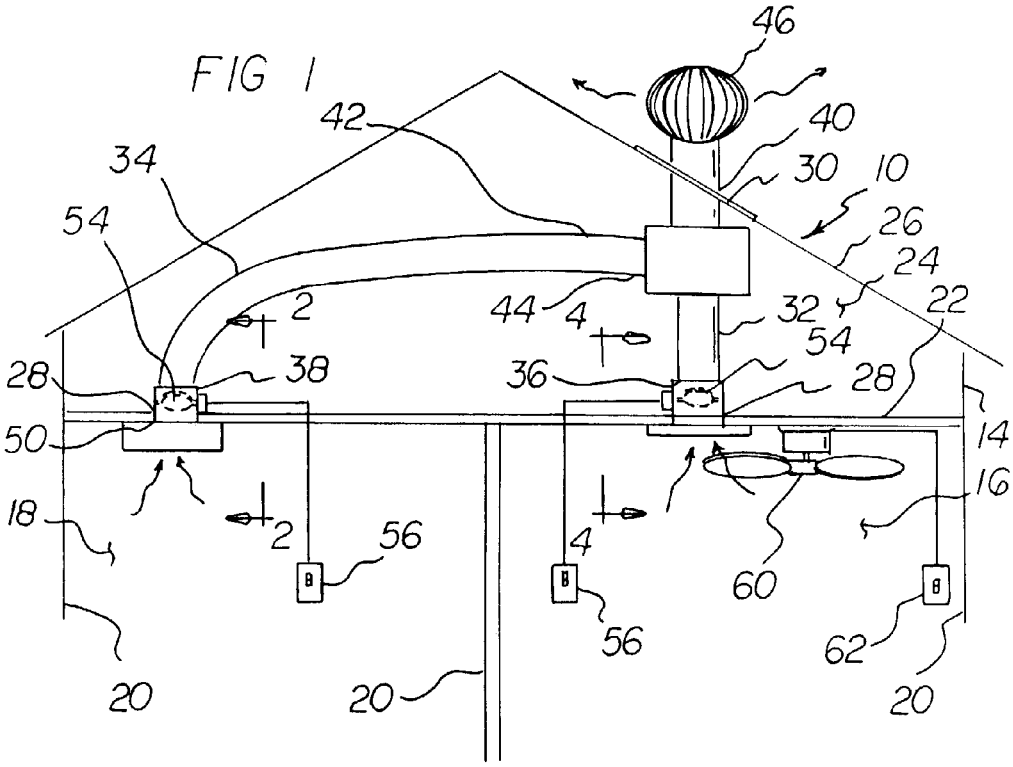
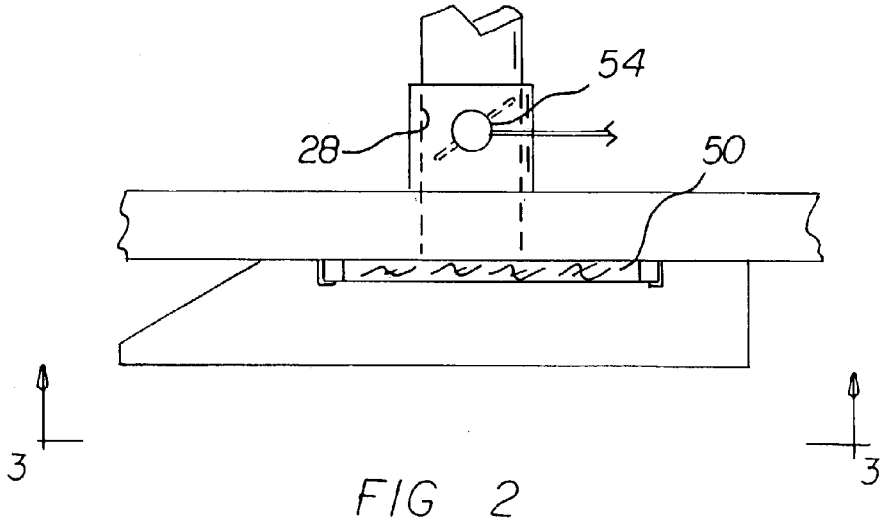
FIG 2

FIG 3
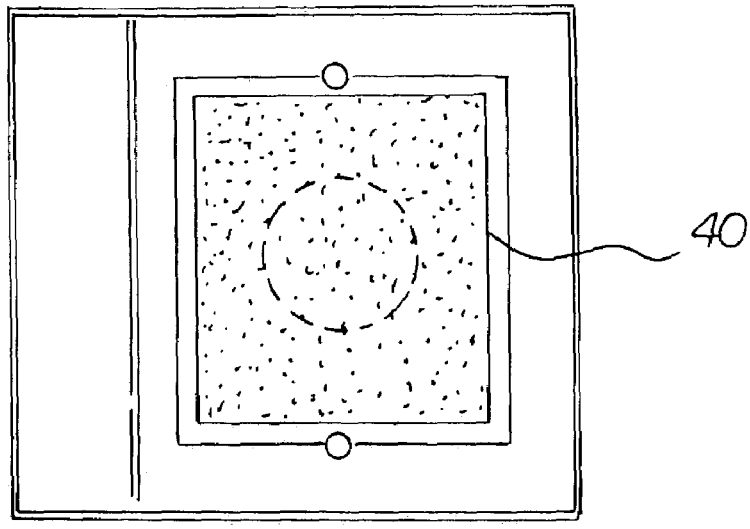
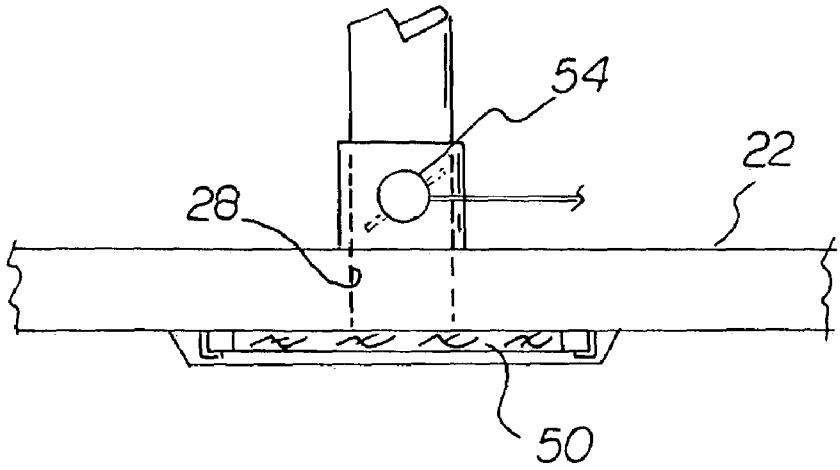
FIG 4

AIR EXHAUST SYSTEM

RELATED APPLICATION

This application is a continuation-in-part of allowed U.S. patent application Ser. No. 09/965,980 filed Sep. 28, 2001, now abandoned, the subject matter of which is incorporated herein by reference.

BACKGROUND OF THE INVENTION

1. Field of the Invention

The present invention relates to an air exhaust system and more particularly pertains to dissipating heat from a chamber through the use of the normal upward flow of heated air.

2. Description of the Prior Art

The use of fans of known designs and configurations is known in the prior art. More specifically, fans of known designs and configurations previously devised and utilized for the purpose of cooling chambers through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 490,027 to Lochman discloses a ventilator. U.S. Pat. No. 3,921,900 to Cole discloses an automatic, temperature responsive damper assembly. U.S. Pat. No. 4,066,064 to Vandas discloses a kitchen ventilator damper actuator and control. U.S. Pat. No. 5,183,435 to Galvez discloses a seasonal attic turbine ventilator. Lastly, U.S. Pat. No. 5,251,815 to Foye discloses a self powered and balancing air damper.

While these devices fulfill their respective, particular objectives and requirements, the aforementioned patents do not describe an air exhaust system that allows dissipating heat from a chamber through the use of the normal upward flow of heated air.

In this respect, the air exhaust system according to the present invention substantially departs from the conventional concepts and designs of the prior art, and in doing so provides an apparatus primarily developed for the purpose of dissipating heat from a chamber through the use of the normal upward flow of heated air.

Therefore, it can be appreciated that there exists a continuing need for a new and improved air exhaust system which can be used for dissipating heat from a chamber through the use of the normal upward flow of heated air. In this regard, the present invention substantially fulfills this need.

SUMMARY OF THE INVENTION

In view of the foregoing disadvantages inherent in the known types of fans of known designs and configurations now present in the prior art, the present invention provides an improved air exhaust system. As such, the general purpose of the present invention, which will be described subsequently in greater detail, is to provide a new and improved air exhaust system and method which has all the advantages of the prior art and none of the disadvantages.

To attain this, the present invention essentially comprises a building. The building has a plurality of chambers. Each chamber has air. The air is adapted to be withdrawn for cooling purposes. Each chamber also has side walls and a ceiling. The ceiling of each chamber has a common attic and roof above the attic. The ceiling is formed of a plurality of air flow apertures. One air flow aperture is provided in each chamber. The roof is formed of a single air flow aperture. Provided next is a plurality of tubular air ducts. Each duct has a lower end open to an associated chamber through an aperture in the ceiling. Each air duct also has an upper end. The upper end extends through the attic and opening to the atmosphere through the aperture in the roof. One of the ducts terminates at an intermediate location of the other duct. A turbine fan is provided next. The turbine fan is operatively coupled with respect to each upper end of the ducts and rotatable about a vertical axis. The turbine fan is adapted to be self rotated in response to the movement of the air there through as the air moves from a location in the chambers, through the ducts to a cooler location above the turbine fan. Next provided are two air filters. Each air filter is located in proximity to the ceiling beneath the lower end and the associated duct. In this manner particulate matter from air passing the associated duct is entrapped. Further provided are two dampers. Each damper is located above an associated filter. Each damper is moveable between a closed orientation and an open orientation. The closed orientation precludes the flow of air through the duct. The open orientation allows the flow of air through a filter. Each damper has an associated electrical switch at an operator's control for changing the orientation of the dampers. The switches are at a remote location from the damper on the wall of its associated chamber. Provided last is a reversible ceiling fan. The ceiling fan depends from the ceiling of at least one of the chambers immediately beneath its associated filter and the lower end of its associated duct. The ceiling fan has a remote switch. The switch is at a remote location from the fan on the wall of its associated chamber to turn on and off the ceiling fan and to reverse its direction of rotation to thereby increase or decrease the flow of air from its associated room through its associated duct to the exterior turbine fan.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved air exhaust system which has all of the advantages of the prior art fans of known designs and configurations and none of the disadvantages.

It is another object of the present invention to provide a new and improved air exhaust system which may be easily and efficiently manufactured and marketed.

It is a further object of the present invention to provide a new and improved air exhaust system which is of durable and reliable constructions.

An even further object of the present invention is to provide a new and improved air exhaust system which is susceptible of a low cost of manufacture with regard to both materials and labor, and which accordingly is then susceptible of low prices of sale to the consuming public, thereby making such air exhaust system economically available to the buying public.

Even still another object of the present invention is to provide an air exhaust system for dissipating heat from a chamber through the use of the normal upward flow of heated air.

Lastly, it is an object of the present invention to provide a new and improved air exhaust system comprises a chamber. The chamber has side walls, a ceiling, an attic and a roof. The ceiling and roof have air flow apertures. Provided next is a duct with upper and lower ends. A turbine fan is provided. The fan is operatively coupled to the upper end of the duct and rotatable about a vertical axis. The fan is further adapted to be self rotated as the air moves from a heated location in the chamber to a cooler location above the fan. Last provided is a damper. The damper is located above the lower end of the duct. The damper is moveable between closed and open orientations. The closed orientation precludes the flow of air through the duct. The open orientation allows for the flow of air through the duct.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the air exhaust system constructed in accordance with the principles of the present invention.

FIG. 2 is a cross-sectional view taken along line 2—2 of FIG. 1.

FIG. 3 is a bottom view of the filter and a portion of the ceiling taken at line 3—3 of FIG. 2.

FIG. 4 is a side elevational view of the damper and filter and lower portion of the duct taken at line 4—4 of FIG. 3.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved air exhaust system embodying the principles and concepts of the present invention and generally designated by the reference numeral 10 will be described.

The present invention, the air exhaust system 10 is comprised of a plurality of components. Such components in their broadest context include a chamber, an air duct, a turbine fan and a damper. Such components are individually configured and correlated with respect to each other so as to attain the desired objective.

First provided is a building 14. The building has a plurality of chambers 16, 18. Each chamber has air. The air is adapted to be withdrawn for cooling purposes. Each chamber also has side walls 20 and a ceiling 22. The ceiling of each chamber has a common attic 24 and roof 26 above the attic. The ceiling is formed of a plurality of air flow apertures 28. One air flow aperture is provided in each chamber. A single air flow aperture 30 is formed in the roof.

Provided next is a plurality of tubular air ducts 32, 34. Each duct has a lower end 36, 38 open to an associated chamber through an aperture in the ceiling. Each air duct also has an upper end 40, 42. The upper end extends through the attic and opening to the atmosphere through the aperture in the roof. One of the ducts terminates at an intermediate location 44 of the other duct.

A turbine fan 46 is provided next. The turbine fan is operatively coupled with respect to each upper end of the ducts and rotatable about a vertical axis. The turbine fan is adapted to be self rotated in response to the movement of the air there through as the air moves from a heated location in the chambers, through the ducts to a cooler location above the turbine fan.

Next provided are two air filters 50. Each air filter is located in proximity to the ceiling beneath the lower end and the associated duct. In this manner particulate matter from air passing the associated duct is entrapped.

Further provided are two dampers 54. Each damper is located above an associated filter. Each damper is moveable between a closed orientation and an open orientation. The closed orientation precludes the flow of air through the duct. The open orientation allows the flow of air through a filter. Each damper has an associated electrical switch 56 at an operator's control for changing the orientation of the dampers. The switches are at a remote location from the damper on the wall of its associated chamber.

Provided last is a reversible ceiling fan 60. The ceiling fan depends from the ceiling of at least one of the chambers immediately beneath its associated filter and the lower end of its associated duct. The ceiling fan has a remote switch 62. The switch is at a remote location from the fan on the wall of its associated chamber to turn on and off the ceiling fan and to reverse its direction of rotation to thereby increase or decrease the flow of air from its associated room through its associated duct to the exterior turbine fan.

As may be seen in FIG. 1, the air duct within the attic includes a linear vertical section 32 which may be a thin wall metal, such as aluminum or a flexible thin wall plastic with a spiral wire for shape retention purposes. The air duct also includes a curved section 34 preferably of a flexible, thin wall plastic with a spiral wire. Due to its construction, the air duct within the attic acts to transfer the heat within the attic to the air within the duct. The air within the pipe is heated fro the entire periphery of the pipe within the attic. Such heating of air within the duct facilitates its movement and the cooling of the air within the chambers of the building.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air exhaust system for dissipating heat from a chamber through the use of the normal upward flow of heated air comprising, in combination:

a building with a plurality of chambers, each chamber having air adapted to be withdrawn for cooling purposes, each chamber having side walls and a ceiling with a common attic and roof there above, the ceiling being formed with a plurality of air flow apertures, one in each chamber and the roof formed with a single air flow aperture;

a plurality of tubular air ducts, each duct having a lower end open to an associated chamber through an aperture in the ceiling, each air duct having an upper end extending through the attic and opening to the atmosphere through the aperture in the roof, one of the ducts terminating at an intermediate location of the other duct;

a turbine fan operatively coupled with respect to each upper end of the ducts and rotatable about a vertical axis, the turbine fan adapted to be self rotated in response to the movement of the air there through as the air moves from a heated location in the chambers, through the ducts to a cooler location above the turbine fan;

at least one air filter, the air filter being located in proximity to the ceiling beneath the lower end of a duct for entrapping particulate matter from air passing there through;

at least one damper being housed within a duct, with the damper being located above a filter and the damper being moveable between a closed orientation to preclude the flow of air through the duct and an open orientation perpendicular to the filter and the air flow to allow the flow of air through a filter and duct, the damper having an associated electrical switch at an operator's control for changing the orientation of the dampers, the switches being at a remote location from the damper on the wall of its associated chamber; and a reversible ceiling fan depending from the ceiling of at least one of the chambers immediately beneath a filter and the lower end of a duct, the ceiling fan having a remote switch to turn on and off the ceiling fan and to reverse the fans's direction of rotation.

2. An air exhaust system for dissipating heat from a chamber through the use of the normal upward flow of heated air comprising, in combination:

a building with a plurality of chambers, each chamber having heated air adapted to be withdrawn for cooling purposes, each chamber having side walls and a ceiling with a common attic and roof there above, the ceiling being formed with a plurality of air flow apertures, one in each chamber and the roof formed with a single air flow aperture;

a plurality of tubular air ducts, each duct having a lower end open to an associated chamber through an aperture in the ceiling, each air duct having an upper end extending through the attic and opening to the atmosphere through the aperture in the roof, one of the ducts terminating at an intermediate location of the other duct;

a turbine fan operatively coupled with respect to each upper end of the ducts and rotatable about a vertical axis, the turbine fan adapted to be self rotated in response to the movement of the air there through as the air moves from a heated location in the chambers, through the ducts to a cooler location above the turbine fan;

two air filters, each located in proximity to the ceiling beneath the lower end and the associated duct for entrapping particulate matter from air passing there through;

two dampers, each located above an associated filter and moveable between a closed orientation to preclude the flow of air through the duct and an open orientation perpendicular to the filter and air flow to allow the flow of air through a filter and duct with an associated electrical switch at an operator's control for changing the orientation of the dampers, the switches being at a remote location from the damper on the wall of its associated chamber; and a reversible ceiling fan depending from the ceiling of at least one of the chambers immediately beneath its associated filter and the lower end of its associated duct, the ceiling fan having a remote switch, the switch being at a remote location from the fan on the wall of its associated chamber to turn on and off the ceiling fan and to reverse its direction of rotation to thereby increase or decrease the flow of heated air from its associated room through its associated duct to the exterior turbine fan.

* * * * *